US009090036B2

(12) United States Patent
Wortmann

(10) Patent No.: US 9,090,036 B2
(45) Date of Patent: Jul. 28, 2015

(54) CRIMPING PRESS

(75) Inventor: Thomas Wortmann, Remscheid (DE)

(73) Assignee: SCHLEUNIGER HOLDING AG, Thun (CH)

( * ) Notice: Subject to any disclaimer, the term of this patent is extended or adjusted under 35 U.S.C. 154(b) by 0 days.

(21) Appl. No.: 13/255,109

(22) PCT Filed: Mar. 25, 2010

(86) PCT No.: PCT/IB2010/051309

§ 371 (c)(1),
(2), (4) Date: Sep. 23, 2011

(87) PCT Pub. No.: WO2010/113085

PCT Pub. Date: Oct. 7, 2010

(65) Prior Publication Data

US 2012/0006210 A1 Jan. 12, 2012

Related U.S. Application Data

(60) Provisional application No. 61/166,246, filed on Apr. 2, 2009.

(30) Foreign Application Priority Data

Apr. 2, 2009 (CH) ..... 539/09

(51) Int. Cl.
*B30B 9/30* (2006.01)
*B30B 15/00* (2006.01)
*H01R 43/048* (2006.01)

(52) U.S. Cl.
CPC ..... *B30B 15/0094* (2013.01); *H01R 43/048* (2013.01); *H01R 43/0486* (2013.01)

(58) Field of Classification Search
CPC .. B30B 15/0094; B30B 15/24; B30B 9/3007; H01R 43/0486; H01R 43/048; H01R 43/0425; H01R 9/0518; H01R 43/055; B21D 5/0272; B21D 11/06; B21C 31/00
USPC ..... 29/751, 753, 863, 407.01, 407.05, 29/407.08, 244, 251; 72/20.1, 20.3, 20.4, 72/21.4, 21.5, 712; 100/46, 50, 231, 258 R, 100/258 A
See application file for complete search history.

(56) References Cited

U.S. PATENT DOCUMENTS 4,411,159 A 10/1983 Spear
4,856,186 A 8/1989 Yeomans
(Continued)

FOREIGN PATENT DOCUMENTS

DE 4330808 A1 3/1995
DE 19622390 A1 12/1996
(Continued)

OTHER PUBLICATIONS

ISR of Swiss(CH) Patent Office in Priority Application No. CH0539/2009, dated Jul. 10, 2009.
(Continued)

*Primary Examiner* — Shelley Self
*Assistant Examiner* — Onekki Jolly
(74) *Attorney, Agent, or Firm* — George Kapsalas; Patentbuero Paul Rosenich AG

(57) ABSTRACT

A crimping press (1) for manufacturing crimp connections is disclosed, comprising a frame (2), a die (14), a plunger (15) movable relative to the frame (2), and a drive (4) attached to the frame (2) for moving the plunger (15). According to the invention, the crimping press (1) furthermore comprises a beam (5) arranged between said drive (4) and said plunger (15) and/or said frame (2) and said die (14) and a sensor (8) for measuring the bending of the beam (5) arranged on or in the beam (5).

20 Claims, 3 Drawing Sheets

(56) References Cited

U.S. PATENT DOCUMENTS

| | | | | |
|---|---|---|---|---|
| 4,914,602 | A | 4/1990 | Abe et al. | |
| 5,101,651 | A * | 4/1992 | Yeomans | 72/21.4 |
| 5,197,186 | A | 3/1993 | Strong et al. | |
| 5,937,505 | A * | 8/1999 | Strong et al. | 29/593 |
| 6,505,494 | B1 * | 1/2003 | Wollermann | 73/1.15 |
| 6,819,116 | B2 | 11/2004 | Ishibashi et al. | |
| 7,024,752 | B2 | 4/2006 | Imgrut | |
| 7,587,918 | B2 | 9/2009 | Imgrut | |
| 2001/0025412 | A1 | 10/2001 | Burger | |
| 2004/0007041 | A1 * | 1/2004 | Imgrut et al. | 72/412 |
| 2007/0062237 | A1 * | 3/2007 | Imgrut | 72/21.4 |
| 2009/0019912 | A1 * | 1/2009 | Yu et al. | 72/402 |

FOREIGN PATENT DOCUMENTS

| | | | | |
|---|---|---|---|---|
| DE | 102004035246 | B3 | 3/2006 | |
| EP | 044191 | A1 | 1/1982 | |
| EP | 291329 | A2 | 11/1988 | |
| EP | 367521 | A1 | 5/1990 | |
| EP | 419129 | A1 | 3/1991 | |
| EP | 460441 | A1 | 12/1991 | |
| EP | 291329 | B1 | 1/1994 | |
| EP | 0291329 | B1 * | 1/1994 | H01R 43/048 |
| EP | 1179877 | A2 | 2/2002 | |
| EP | 1179877 | B1 | 11/2004 | |
| EP | 878878 | B1 | 1/2005 | |
| EP | 1515410 | A2 | 3/2005 | |
| EP | 1635432 | A1 | 3/2006 | |
| EP | 1635432 | B1 | 12/2006 | |
| EP | 1515410 | B1 | 10/2007 | |
| JP | H09-153676 | A | 6/1997 | |
| JP | 2005-141909 | A | 2/2005 | |
| JP | 2006-351451 | A | 12/2006 | |
| JP | 5554828 | B2 | 7/2014 | |
| WO | WO 2008/049796 | * | 4/2008 | B21D 5/02 |
| WO | 2008/049796 | A1 | 5/2008 | |

OTHER PUBLICATIONS

PCT International Search Report and Written Opinion from WO2010/113085A1 parent PCT application to the present application; mailed Jul. 5, 2010 by WIPO.

Popov, E.P. Mechanics of Materials, 2nd ed. Prentice-Hall Incorporated, New Jersey. 1976. pages: front matter(bibliographic data), 1-11, 33-47, 91-112, 119-155, 163-190, 199-218, 261-269, 323-328, 353-393.

Eshbach, O.W. et al. Handbook of Engineering Fundamentals, 3rd ed. John Wiley&Sons, New York. 1975. pages: front matter(bibliographic data), 487-500, 501-528.

Timoshenko, S.P. et al. Theory of Elasticity, 3rd ed. McGraw-Hill Book Co., New York. 1970. pages: front matter(bibliographic data), 8-11, 53-60, 354-379.

Shames, I.P. Mechanics of Deformable Solids. Robert E. Krieger Publ. Co., Inc., New York. 1979. pages: front matter(bibliographic data), 171-206, 213-242, 243-267.

* cited by examiner

CRIMPING PRESS

This application is a section 371 national-phase entry of PCT International application no. PCT/IB2010/051309 filed on Mar. 25, 2010 and published as WO2010/113085A1 on Oct. 7, 2010; application no. PCT/IB2010/051309 claims benefit of priority to Swiss application no. 00539/09 filed on Apr. 2, 2009, and claims benefit as a non-provisional of prior U.S. provisional application No. 61/166,246 filed on Apr. 2, 2009; the entireties of PCT International application no. PCT/IB2010/051309, of Swiss application no. 00539/09 and of prior U.S. provisional application No. 61/166,246 are all expressly incorporated herein by reference, for all intents and purposes, as if identically set forth in full herein.

TECHNICAL FIELD

The invention relates to a crimping press for manufacturing crimp connections, comprising a frame, a die, a plunger (or a ram) movable relative to the frame, and a drive attached to the frame for moving the plunger.

BACKGROUND OF THE INVENTION

Crimping, which is a special kind of beading, is a method for joining parts, in particular a wire with a connector (often having the shape of a plug), by plastic deformation. The resulting permanent joint provides good electrical and mechanical stability and is thus a suitable alternative to other connecting methods such as welding or soldering. Hence, common fields of application for crimping are electric devices (e.g. for telecommunication, electrical equipment for vehicles, etc.). The shape of a crimp should exactly be adapted to the wire so as to provide for a predetermined deformation of the same. Crimping usually is done by a crimping gripper or a crimping press.

According to prior art, the force acting during the crimping process can be measured to monitor and/or ensure a constant quality of crimp connections manufactured by a crimping press. For example, pressure sensors are utilized for this reason, which measure the force between the frame and the die and/or the drive and the plunger. A further possibility is to evaluate the deformation of the frame.

While the measuring methods mentioned hereinbefore turned out to be notably suitable for crimping presses, further possibilities for the measurement of pressure forces are known in principle from other, outlying technical areas.

For example, JP 091 53676 discloses a device for soldering electronic devices onto a printed circuit board. A heating element is forced onto the electronic device so as to cause the soldering. These or similar devices are also referred to as "thermodes". The force, which acts on the heating element, is measured by means of a strain gauge attached to a beam, which is asymmetrically loaded.

Furthermore, DE 10 2004 035 246 B3 discloses a force sensor for a press, wherein the force acting on a plunger is measured by an optical sensor, which monitors the bending of a leaf spring.

EP 0 044 191 A1 discloses yet another solution for measuring a load via the deformation of a leaf spring, in particular for measuring the loads acting on a vehicle. In this configuration, strain gauges are used to perform the measurement.

Finally, DE 43 30 808 A1 discloses a sensor to monitor the load acting on a tool by means of the bending of a beam, which is arranged between the tool and a frame. The sensor measures the distance between a bent beam and an unloaded beam.

Unfortunately, the crimping presses known in the art have disadvantages insofar as the force measurement by evaluating the deformation of the frame is relatively inaccurate because the measurement takes place off the plunger and the die. Thus, the measurement result includes a lot of disturbing influences. The measurement by means of pressure sensors circumvents this problem but generates another one because pressure sensors are technically complex and thus expensive. Because of their complexity, pressure sensors are furthermore more prone to failure.

Moreover, solutions known from other, outlying technical areas cannot be used for crimping presses either. For example, the solution known from JP 091 53676 needs relatively complex guidings inducing a lot of bearing clearance because of the asymmetrically loaded beam. A measuring unit having bearing clearance to such an extent is not suitable for a crimping press, where the die and the plunger have to be aligned very exactly. Furthermore, the magnitude of the forces exhibited by a thermode is much lower than by a crimping press because the joint is not caused by mechanical deformation but by liquefaction of a solder. Concluding, the solution known from JP 091 53676 cannot be adapted for crimping presses in principle.

The solution known from DE 10 2004 035 246 cannot be used for crimping presses either because the indirect, optical measurement of the bending of a leaf spring implies relatively strong deformations of the same. Accordingly, it is not possible to measure the force and the travel distance of the plunger at the same time. However, this combined measurement usually is required for crimping presses because in addition to the condition that a particular force or a particular force progression should be met for a high-quality crimp there is also a need to meet a particular travel distance of the plunger. If the plunger travels too far, the crimp gets damaged, if it does not travel far enough, the crimp may be loose. Accordingly, the leaf spring of DE 10 2004 035 246 is not suitable for crimping presses. The arguments discussed for DE 10 2004 035 246 are equally applicable to EP 0 044 191 A1 and DE 43 30 808 A1 because these measurement methods also involve relatively strong deformations. Leaf springs for vehicles, as they are disclosed EP 0 044 191 A1, are traditionally designed to perform a strong bending so as to make travelling more comfortable. The same counts for DE 43 30 808 A1 because measuring the load via the distance between a bent beam and an unloaded beam either requires a long beam or a soft (loaded) beam so as to cause a substantial measuring distance. Both is not suitable for crimping presses.

OBJECT AND SUMMARY OF THE INVENTION

Thus, the object of the invention is to provide a crimping press which allows for an improved measurement of the forces occurring during crimping without having the disadvantages mentioned hereinbefore.

The object of the invention is achieved by a crimping press of the kind disclosed in the first paragraph, additionally comprising:

- a beam arranged between said drive and said plunger and/or said frame and said die and
- a sensor for measuring the bending of the beam arranged on or in the beam.

In other words, the object of the invention is achieved by the deep insight, that a beam in the flux of force may be used for measuring forces occurring in a crimping press.

By means of these features, the disadvantages of the crimping presses known in the art are overcome. For example, disturbance and noise as it is known from presses having sensors on the frame are eliminated because according to the invention the entire flux of force occurring during crimping is lead over the beam with the sensor. In contrast to known crimping presses with pressure sensors, the invention provides for utilization of relatively simple and cheap bending sensors respectively strain sensors. For example, common strain gauges, especially used in a bridge, as well as piezoelectric sensors may be utilized. Thus, the force occurring during crimping can be measured with simple means and moreover substantially without disturbing influence.

Advantageous versions of the invention are disclosed in the written content and the figures of this application.

It is advantageous if a) a force acting on the plunger/the die is fed into a portion of the beam, which is situated between portions of the beam, into which a driving force/holding force from the drive/the frame is fed or b) a driving force/holding force from the drive/the frame is fed into a portion of the beam, which is situated between portions of the beam, into which a force acting on the plunger/the die is fed.

In this way the beam may be loaded symmetrically, which is advantageous for the flux of force (e.g. in contrast to the solution of JP 09153676, where one side of the beam is connected to the drive and the other one is connected to the heating device). However, the load distribution does not need to be "fully" symmetrical, meaning that the center load being somewhere in-between of the portions of the outer loads is sufficient.

In an advantageous embodiment, the beam is T-shaped with a center part and a crossbar connected thereto. In this embodiment, the center part of a T-shaped beam provides for an easy possibility for connecting the beam to the crimping press without weakening it (as it is the case if holes are provided for connecting the beam for example). Thus, the beam is suitable for high loads as they may occur during crimping.

In this context, it is advantageous if in case a) the force acting on the plunger/the die is fed into the center part and the driving force/holding force is fed into the crossbar or in case b) the driving force/holding force is fed into the center part and the force acting on the plunger/the die is fed into the crossbar.

Furthermore, it is particularly advantageous in this context if the center part of the beam is provided for holding the plunger. In this way the center part may be shaped to receive the plunger.

In yet another advantageous embodiment, the beam is one-piece. In this case the beam is particularly robust as there are no joints. Thus it is well suitable for the high loads occurring during crimping.

Furthermore, it is advantageous if the sensor is designed as a strain gauge and in case a) is arranged opposite to the portion for feeding the force acting on the plunger/the die or in case b) is arranged opposite to the portion for feeding the drive force/holding force.

In this embodiment of the invention, the space on the beam is optimally used. However, instead of a strain gauge a piezoelectric sensor may equally be used.

Finally, it is advantageous if a contact area between the beam and other parts, to which the beam is connected, is small in relation to the total surface of the beam, on which surface said contact area is arranged. In this way, a disturbing influence of the friction in the contact area, possibly foiling the force measurement, can be reduced. For this reason, the beam may have protrusions or a shim may be arranged in the contact area.

The embodiments disclosed hereinbefore may be combined in any desired way.

BRIEF DESCRIPTION OF THE DRAWINGS

The present invention is discussed hereinafter by means of schematic figures and drawings, which illustrate the embodiments of the invention. These figures, drawings and embodiments are however not intended to limit the broad scope of the invention. The Figs. show.

DETAILED DESCRIPTION

Figure 1:
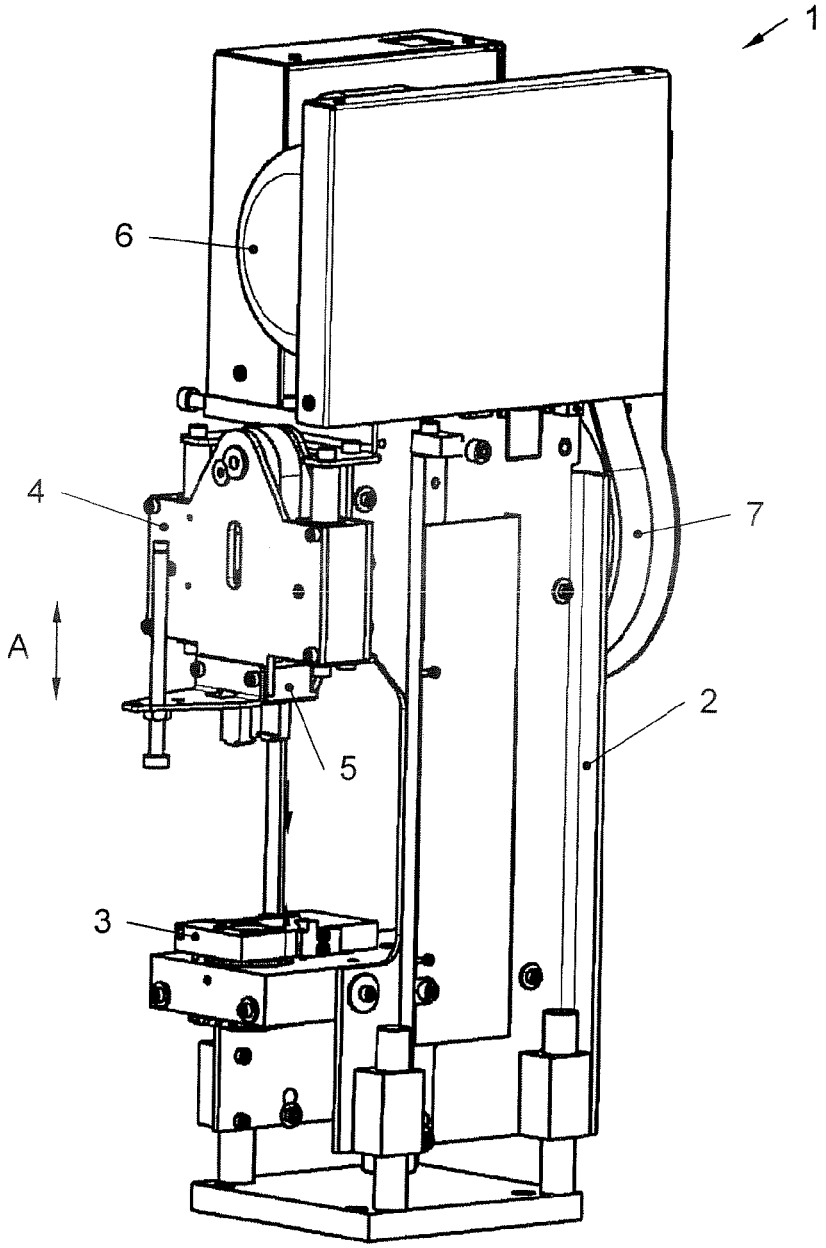
FIG. 1 an inventive crimping press in perspective view according to one embodiment, FIG. 2 a detail of the crimping press of FIG. 1, basically the beam and the drive, FIG. 3 an inventive crimping press in perspective view according to one version, including depiction of a plunger and a die.

FIG. 1 schematically shows an inventive crimping press 1 in perspective view according to one embodiment of the invention. The crimping press 1 comprises a frame 2, a die holder 3, a drive 4, a beam 5, a die and a plunger (not shown as they are detached). Furthermore, an electric motor 6 and a belt pulley 7 are shown, which are used for moving the drive 4. The crimping press 1 also comprises other parts which are needed for its function but are not essential for the invention and thus are not denoted for the sake of brevity. However, that does not mean that every denoted part necessarily is essential for the invention.

Figure 3:
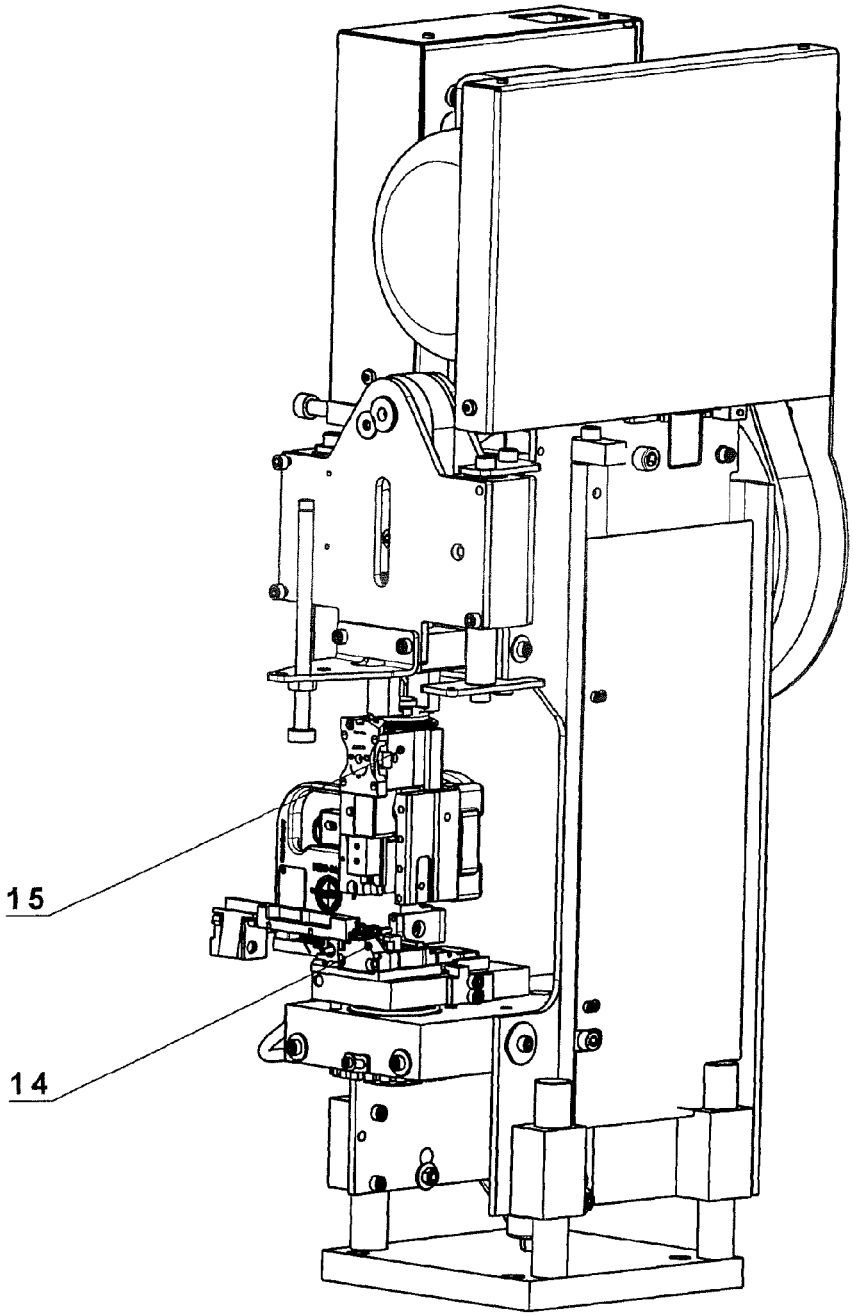

In this embodiment, the die holder 3 is directly (that means without an inventive beam) fixed to the frame 2 by means of screws. The drive 4 may be linearly moved upwards and downwards by means of the electric motor 6 (see arrows A). Turning to FIG. 3, it has some similarity to FIG. 1 but illustrates one version with a depicted location of a die (14) and a plunger (15). If a crimp with a wire is put into the die (14) and the crimping press 1 is activated, the drive 4 moves downwards and the plunger (15) performs the crimping as it is known in the art.

It should be noted that there are also crimping presses 1, where both the plunger and the die move. In this case the distinction between plunger and die gets somewhat blurred, so that one may say that a crimping press may have two plungers. One skilled in the art will appreciate that the disclosure of this invention may easily be adapted to such a crimping press accordingly.

Figure 2:
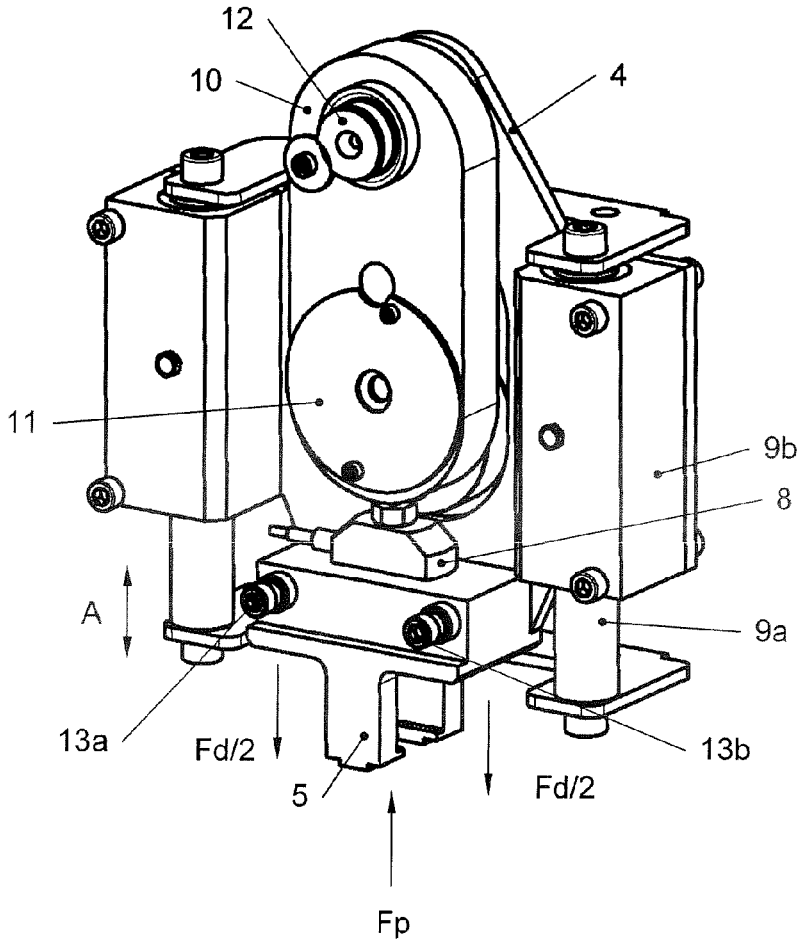

FIG. 2 now shows a detail of the crimping press 1 of FIG. 1 (without its front cover), that is the drive 4 with the beam 5 connected thereto and a sensor 8 mounted on the beam 5. Again, the plunger is not shown as it is detached. Furthermore, FIG. 2 shows linear guidings each comprising a fixed rod 9*a* and a moveable slider 9*b*, to which further parts, inter alia the beam 5, are attached. The complete unit, which may move relative to the fixed rod 9*a* of the linear guiding except of the beam 5, the sensor 8 and the plunger is referenced to as drive 4. Accordingly, one will appreciate that the term "drive" does not necessarily mean a (rotational) motor in this context but rather a linear motor. However, a rotational movement may be transformed into a linear movement for this reason as applicable.

In this example, the belt pulley 7 comprises an excentric bolt, which extends into a connecting rod 10 (in the FIG. 2 just a cover 11 is shown at this position). On the upper side of the connecting rod 10, there is an upper bolt 12 which connects the connecting rod 10 to the drive 4. Accordingly, the electric motor 6 transmits its power to the drive 4 via the belt pulley 7 and the connecting rod 10. However, other motors for moving the drive 4 are applicable as well as, for example, pneumatic and hydraulic motors.

The T-shaped, one-piece beam 5 is screwed to the drive 4 at the outer portions of the crossbar by means of screws 13*a* and 13*b*. The center part is designed to receive the plunger. In this embodiment, plungers for different crimps may easily be changed by shifting them into the respectively out off the center part.

FIG. 2 also shows the forces acting on the beam 5, i.e. the plunger force Fp and the driving force Fd (Fd/2 on each side of the beam 5).

Accordingly, the force acting on the plunger Fp is fed into the center part and the driving force Fd is fed into the crossbar. One will also easily understand that the force acting on the plunger Fp is fed into a portion of the beam 5, which is situated between portions of the beam 5, into which a driving force Fd from the drive 4 is fed.

In this embodiment, the sensor 8 is designed as a piezoelectric sensor and is arranged opposite to the portion for feeding in the plunger force Fp, i.e. opposite to the center bar of the T-shaped beam 5. These sensors provide a signal (in this case even an active one) if the sensor 8 (i.e. the piezoelectric crystal) is deformed as it is known in the art. However, other embodiments are equally imaginable. For example, the sensor 8 may be mounted on the side, where the plunger force Fp is fed into the beam 5. There may also be dedicated "bending" sensors at the side of the beam (note that the bending of the beam causes just strain on the top and the bottom of the beam 5). It is particularly advantageous if the sensors are arranged in a bridge as it is known in the art. However, it is also possible to use a strain gauge instead of the piezoelectric sensor, particularly arranged in a bridge. Finally, a sensor 8 is not necessarily mounted on the beam 5 but may also be arranged within the beam 5, e.g. in a hole provided therefor. In this way, the sensor 8 can be protected from environmental influence.

It should be noted, that the beam 5 may also have a different shape, in particular it may be a simple straight beam. Furthermore the T-shaped beam 5 of FIG. 2 may be mounted the other way around, meaning that the center part is connected to the drive 4 and the crossbar is connected to the plunger.

It should also be noted at this point that similar configurations may additionally or alternatively be provided for the die. In this case, a beam is provided between the die and the frame 2. One skilled in the art will easily adapt the teaching of this disclosure to such a configuration, where the force occurring crimping is measured via the die.

Furthermore, it should be noted that "a beam arranged between the drive and the plunger and/or the frame and the die" does not necessarily mean that said parts are directly connected to each other. By contrast, there may also be further intermediate parts.

Finally, it should be noted that the above-mentioned embodiments illustrate rather than limit the invention, and that those skilled in the art will be capable of designing many alternative embodiments without departing from the scope of the invention as defined by the appended claims. The scope of the present invention is defined by the appended claims, including known equivalents and unforeseeable equivalents at the time of filing of this application. In the claims, any reference signs placed in parentheses shall not be construed as limiting the claims. The verb 'comprise' and its conjugations do not exclude the presence of elements or steps other than those listed in any claim or the specification as a whole. The singular reference of an element does not exclude the plural reference of such elements and vice-versa. The mere fact that certain measures are recited in mutually different dependent claims does not indicate that a combination of these measures cannot be used to advantage.

LIST OF REFERENCE LABELS

1 crimping press
2 frame
3 die holder
4 drive
5 beam
6 electric motor
7 belt pulley
8 sensor
9*a* fixed rod of linear guiding
9*b* movable slider of linear guiding
10 connecting rod
11 cover
12 upper bolt
13*a* . . . 13*b* screws
14 die
15 plunger
A moving direction of the plunger
Fd driving force
Fp plunger force

What is claimed is:

1. A crimping press comprising:
a frame;
a die supported by said frame;
a plunger configured to move relative to said frame;
a drive connected to said frame and configured to move said plunger;
a beam arranged between said drive and said plunger, said beam having a first portion receiving force acting on said plunger, a second portion, a third portion, said first portion situated between said second and third portions, said second and third portions receiving force acting from said drive; and,
a sensor configured to measure lateral, beam deflection bending of said beam consequent to beam cross sectional area moment of inertia.

2. A crimping press as claimed in claim 1, further comprising:
said beam having a center part, said beam having a crossbar, said center part and said crossbar forming a T-shape.

3. The crimping press as claimed in claim 1, wherein:
said sensor is a strain gauge.

4. The crimping press as claimed in claim 3, wherein:
said strain gauge is arranged opposite to said first portion.

5. The crimping press as claimed in claim 1, wherein:
said sensor is a piezoelectric sensor arranged opposite to said first portion.

6. A crimping press comprising:
a frame;
a die supported by said frame;
a plunger configured to move relative to said frame;
a drive connected to said frame and configured to move said plunger;
a beam arranged between said frame and said die, said beam having a first portion receiving force acting on said die, a second portion, a third portion, said first portion situated between said second and third portions, said second and third portions receiving force acting from said frame; and, a sensor configured to measure lateral, beam deflection bending of said beam consequent to beam cross sectional area moment of inertia.

7. A crimping press as claimed in claim 6, further comprising:

said beam having a center part, said beam having a crossbar, said center part and said crossbar forming a T-shape.

8. The crimping press as claimed in claim 6, wherein:

said sensor is a strain gauge.

9. The crimping press as claimed in claim 8, wherein:

said strain gauge is arranged opposite to said first portion.

10. The crimping press as claimed in claim 6, wherein:

said sensor is a piezoelectric sensor arranged opposite to said first portion.

11. A crimping press comprising:

a frame;

a die supported by said frame;

a plunger configured to move relative to said frame;

a drive connected to said frame and configured to move said plunger;

a beam arranged between said drive and said plunger, said beam having a first portion receiving a driving force of said drive, a second portion, a third portion, said first portion situated between said second and third portions, said second and third portions receiving force acting on said plunger; and, a sensor configured to measure lateral, beam deflection bending of said beam consequent to beam cross sectional area moment of inertia.

12. A crimping press as claimed in claim 11, further comprising:

said beam having a center part, said beam having a crossbar, said center part and said crossbar forming a T-shape.

13. The crimping press as claimed in claim 11, wherein:

said sensor is a strain gauge.

14. The crimping press as claimed in claim 13, wherein:

said strain gauge is arranged opposite to said first portion.

15. The crimping press as claimed in claim 11, wherein:

said sensor is a piezoelectric sensor arranged opposite to said first portion.

16. A crimping press comprising:

a frame;

a die supported by said frame;

a plunger configured to move relative to said frame;

a drive connected to said frame and configured to move said plunger;

a beam arranged between said frame and said die, said beam having a first portion receiving a holding force acting from said frame, a second portion, a third portion, said first portion situated between said second and third portions, said second and third portions receiving force acting on said die; and, a sensor configured to measure lateral, beam deflection bending of said beam consequent to beam cross sectional area moment of inertia.

17. A crimping press as claimed in claim 16, further comprising:

said beam having a center part, said beam having a crossbar, said center part and said crossbar forming a T-shape.

18. The crimping press as claimed in claim 16, wherein:

said sensor is a strain gauge.

19. The crimping press as claimed in claim 18, wherein:

said strain gauge is arranged opposite to said first portion.

20. The crimping press as claimed in claim 16, wherein:

said sensor is a piezoelectric sensor arranged opposite to said first portion.

* * * * *